US010473111B2

(12) United States Patent
Vetters

(10) Patent No.: US 10,473,111 B2
(45) Date of Patent: Nov. 12, 2019

(54) VARIABLE PITCH FAN FOR A GAS TURBINE ENGINE

(71) Applicant: Rolls-Royce Corporation, Indianapolis, IN (US)

(72) Inventor: Daniel K. Vetters, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 204 days.

(21) Appl. No.: 15/787,294

(22) Filed: Oct. 18, 2017

(65) Prior Publication Data

US 2019/0113049 A1 Apr. 18, 2019

(51) Int. Cl.

| | |
|---|---|
| ***F04D 29/36*** | (2006.01) |
| ***F04D 29/38*** | (2006.01) |
| ***F04D 29/32*** | (2006.01) |
| *F04D 29/059* | (2006.01) |

(52) U.S. Cl.

CPC ..... *F04D 29/362* (2013.01); *F04D 29/323* (2013.01); *F04D 29/329* (2013.01); *F04D 29/38* (2013.01); *F04D 29/059* (2013.01)

(58) Field of Classification Search

CPC ..... F04D 29/362; F04D 29/38; F04D 29/329; F04D 29/059; F01D 5/147; F01D 5/303; F01D 5/32; F05D 2250/90

See application file for complete search history.

(56) References Cited

U.S. PATENT DOCUMENTS

| | | | | |
|---|---|---|---|---|
| 2,844,303 | A | 7/1958 | Kristiansen | |
| 3,085,631 | A | 4/1963 | Dagrell | |
| 3,907,460 | A | 9/1975 | Pedersen et al. | |
| 3,920,353 | A | 11/1975 | Bredsted | |
| 4,573,874 | A | 3/1986 | Andersen et al. | |
| 4,630,999 | A | 12/1986 | De La Harpe | |
| 7,682,128 | B2 | 3/2010 | Kinzer | |
| 2016/0265547 | A1* | 9/2016 | Fulayter | B64C 11/325 |
| 2016/0290228 | A1* | 10/2016 | van der Merwe | F16C 19/547 |
| 2017/0314562 | A1* | 11/2017 | Rose | F02K 3/06 |
| 2018/0043997 | A1* | 2/2018 | Ramakrishnan | B64C 21/06 |
| 2018/0306201 | A1* | 10/2018 | Craig | F04D 29/644 |
| 2019/0017396 | A1* | 1/2019 | Lopez Guzman | F01D 7/00 |

OTHER PUBLICATIONS

Thomas G. Cloft and Patricia L. Muldoon, Ultra High Bypass (UHB) Engine Critical Component Technology, The American Society of Mechanical Engineers, 1989, 8 pages.

Brian E. Fite, Fan Performance From Duct Rake Instrumentation on a 1.294 Pressure Ratio, 725 ft/sec Tip Speed Turbofan Simulator Using Vaned Passage Casing Treatment, NASA, Apr. 2006, 63 pages.

Robert J. Jeracki, Comprehensive Report of Fan Performance From Duct Rake Instrumentation on a 1.294 Pressure Ratio, 806 ft/sec Tip Speed Turbofan Simulator Models, NASA, Feb. 2006, 149 pages.

(Continued)

*Primary Examiner* — Sizo B Vilakazi

(74) *Attorney, Agent, or Firm* — Barnes & Thornburg LLP

(57) ABSTRACT

A gas turbine engine includes a fan having a plurality of fan blades configured to rotate about a central axis of the gas turbine engine. Each fan blade is configured to pivot about a pitch axis that extends radially away from the central axis to vary a pitch of the fan blade.

20 Claims, 4 Drawing Sheets

(56) References Cited

OTHER PUBLICATIONS

William S. Willis, Quiet Clean Short-Haul Experimental Engine (QCSEE) Final Report, NASA, Aug. 1979, 312 pages.
Robert A. Schwartz, Paul Carvalho, and Mark J. Cutler, Large Scale Advanced Prop-Fan (LAP) Pitch Change Actuator and Control Design Report, NASA, Jan. 31, 1986, 216 pages.
David A. Topol, Clint L. Ingram, Michael J. Larkin, Charles H. Roche, and Robert D. Thulin, Advanced Subsonic Technology (AST) 22-Inch Low Noise Research Fan Rig Preliminary Design of ADP-Type Fan 3, NASA, Feb. 2004, 68 pages.
G.H.Wright & J.G. Russell, the M.45SD-02 variable pitch geared fan engine demonstrator test and evaluation experience, Aeronautical Journal, Sep. 1980, 10 pages.

* cited by examiner

VARIABLE PITCH FAN FOR A GAS TURBINE ENGINE

FIELD OF THE DISCLOSURE

The present disclosure relates generally to gas turbine engines, and more specifically to fans used with gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, a fan to generate thrust to propel the aircraft. Left-over products of the combustion are exhausted out of the turbine and may provide additional thrust in some applications.

In some propeller driven aircraft, the propeller blades are configured to pivot about their respective axis to vary a pitch of the propeller blades. The pitch of the blades may be controlled using actuators and/or counterweights coupled directly to the propeller blades. However, such control methods may be limited by design space and weight allocations when incorporated into fans used with gas turbine engines.

SUMMARY

The present disclosure may comprise one or more of the following features and combinations thereof.

According to embodiments of the present disclosure, a variable-pitch fan for use with a gas turbine engine includes a fan disk, a fan blade, and a mount system. The fan disk is mounted for rotation about a central axis and is formed to include a disk aperture that extends radially into the fan disk. The fan blade is coupled to the fan disk for primary rotation with the fan disk about the central axis to produce thrust and for variable-pitch rotation about a pitch axis that extends radially from the central axis. The fan blade includes a shank arranged in the disk aperture and an airfoil that extends radially away from the fan disk.

In illustrative embodiments, the mount system is configured to support the shank of the fan blade in the disk aperture. The mount system includes an inner bearing unit, an outer bearing unit, and a retention plate. The inner and outer bearing units are located in the disk aperture and are arranged between the fan blade and the fan disk to bear force loads applied between the fan blade and the fan disk.

In illustrative embodiments, the retention plate is arranged around the shank of the fan blade. The retention plate is configured to couple selectively with the fan disk to block movement of the fan blade with the outer bearing unit out of the disk aperture and is configured to uncouple selectively from the fan disk to allow radial outward movement of the fan blade with the outer bearing unit out of the disk aperture relative to the central axis.

In illustrative embodiments, the inner bearing unit includes a roller bearing unit configured to bear radial force loads relative to the pitch axis. The outer bearing unit includes a spherical tapered roller bearing unit configured to bear axial and radial force loads and configured to tolerate misalignment of the shank of the fan blade in the disk aperture. In some embodiments, the outer bearing unit includes a tapered roller bearing unit. The inner bearing unit and the outer bearing unit are the only bearings arranged around the shank of the fan blade.

In illustrative embodiments, the inner bearing unit is spaced apart radially from the retention plate relative to the central axis and the outer bearing unit is located radially between the inner bearing unit and the retention plate. The inner bearing unit is spaced apart radially from the retention plate relative to the central axis and the outer bearing unit is located radially between the inner bearing unit and the retention plate.

In illustrative embodiments, the airfoil includes composite material and the shank includes metallic material and the airfoil is coupled to the shank for movement therewith. The shank includes a shank shaft and a shoulder body. The shank shaft extends axially into the disk aperture relative to the pitch axis from the shoulder body. The shoulder body extends radially outward from the shank shaft relative to the pitch axis. The shank shaft forms an inner race of the inner bearing unit.

In illustrative embodiments, the variable-pitch fan further includes a pitch controller configured to rotate about the central axis with the fan disk. The pitch controller includes a spline shaft that extends radially away from the central axis into the disk aperture and a rotator control coupled to the spline shaft and configured to rotate the spline shaft about the pitch axis. The shank shaft is formed to include a shank aperture that extends axially into the shank shaft relative to the pitch axis and the spline shaft of the pitch controller extends into the shank aperture to couple the fan blade with the pitch controller.

Another aspect of the present disclosure includes a variable-pitch fan for use with a gas turbine engine. The variable-pitch fan includes a fan disk, a fan blade, and a mount system. The fan disk is mounted for rotation about a central axis. The fan blade extends into the fan disk for primary rotation with the fan disk about the central axis and for variable-pitch rotation about a pitch axis that extends radially from the central axis. The fan blade includes a shank that extends into the fan disk and an airfoil that extends radially away from the fan disk.

In illustrative embodiments, the mount system includes an outer bearing unit and a retention plate. The outer bearing unit is coupled to the shank of the fan blade. The retention plate is arranged around the shank of the fan blade and is configured to couple selectively with the fan disk to block movement of the fan blade and the outer bearing unit away from the fan disk and is configured to uncouple selectively from the fan disk to allow movement of the fan blade and the outer bearing unit away from the fan disk.

In illustrative embodiments, the mount system further includes an inner bearing unit and the outer bearing unit and the inner bearing unit are the only bearing units arranged around the fan blade. The inner bearing unit includes a roller bearing unit and the outer bearing unit includes a spherical tapered roller bearing unit. The inner bearing unit is spaced apart radially from the retention plate relative to the central axis and the outer bearing unit is located radially between the inner bearing unit and the retention plate.

In illustrative embodiments, the shank includes a shank shaft and a shoulder body. The shank shaft extends into the fan disk and the shoulder body extends radially outward from the shank shaft relative to the pitch axis. The shank shaft forms an inner race of the inner bearing unit.

In illustrative embodiments, the variable-pitch fan further includes a pitch controller configured to rotate about the central axis with the fan disk. The pitch controller includes a spline shaft that extends radially away from the central axis into the spline shaft and a rotator control coupled to the spline shaft and configured to rotate the spline shaft about the pitch axis.

Another aspect of the present disclosure includes a method of replacing an individual fan blade. In illustrative embodiments, the method includes providing a variable-pitch fan including a fan disk mounted for rotation about a central axis, a plurality of fan blades coupled to the fan disk for primary rotation around the central axis, and a respective mount system for each of the fan blades. Each mount system includes an inner bearing unit coupled to the fan disk, an outer bearing unit coupled to the fan blade radially outward of the inner bearing unit, and a retention plate coupled to the fan disk radially outward of the outer bearing unit.

In illustrative embodiments, the method further includes moving the fan blade, the outer bearing unit, and the retention plate radially outward away from the fan disk to separate the fan blade, the outer bearing unit, and the retention plate from the fan disk. The fan blade includes an airfoil and a shank coupled to the airfoil and the shank forms an inner race of the inner bearing unit. The inner bearing unit includes a roller bearing unit and the outer bearing unit includes a spherical tapered roller bearing.

These and other features of the present disclosure will become more apparent from the following description of the illustrative embodiments.

DETAILED DESCRIPTION OF THE DRAWINGS

Figure 1:
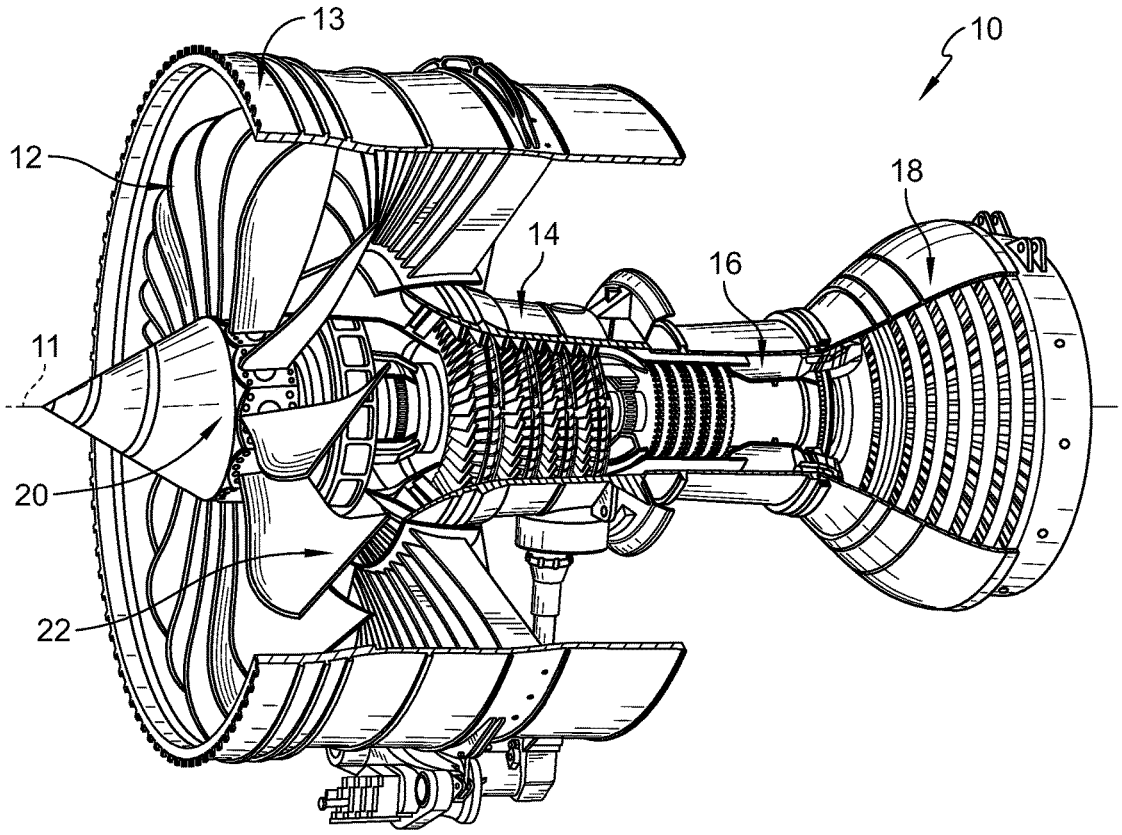
FIG. 1 is a cutaway view of a gas turbine engine in accordance with the present disclosure, the gas turbine engine includes a variable-pitch fan, a compressor, a combustor, and a turbine, the variable-pitch fan includes a plurality of fan blades mounted for rotation about a central axis of the gas turbine engine, and each fan blade is configured to pivot about a fan-pivot rotation axis that extends radially away from the central axis through the fan blade to vary a pitch of the fan blade.

For the purposes of promoting an understanding of the principles of the disclosure, reference will now be made to a number of illustrative embodiments illustrated in the drawings and specific language will be used to describe the same.

A gas turbine engine 10 having a variable-pitch fan 12 in accordance with the present disclosure is shown in FIG. 1. The variable-pitch fan 12 includes a plurality of fan blades 22 arranged around a central axis 11 of the gas turbine engine 10. Each fan blade 22 is configured to pivot about a fan-blade pitch axis 27 that extends radially away from the central axis 11 to vary a pitch of the fan blade 22. Each of the fan blades 22 includes a respective mount system 24 that allows individual replacement of the variable fan blades 22 while the gas turbine engine 10 is attached on-wing to an aircraft as suggested in FIG. 2.

The gas turbine engine 10 includes the variable-pitch fan 12, a compressor 14, a combustor 16, and a turbine 18 as shown in FIG. 1. The variable-pitch fan 12 is driven by the turbine 18 and provides thrust for propelling an aircraft. The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 to cause the turbine 18 to rotate about the central axis 11 of the gas turbine engine 10 and drive the compressor 14 and the variable-pitch fan 12.

Figure 2:
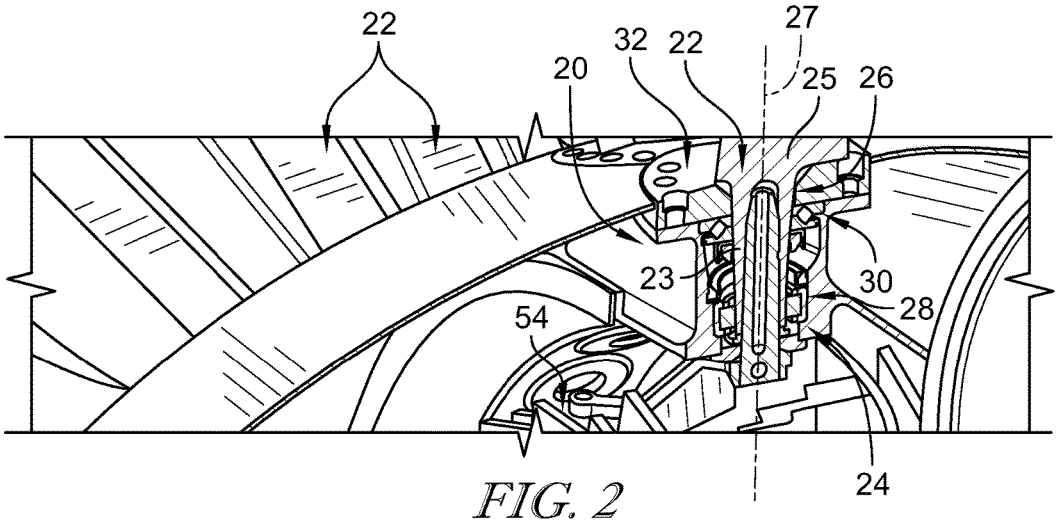
FIG. 2 is a perspective and section view of the variable-pitch fan of FIG. 1 showing that each fan blade is coupled to a fan disk for rotation with the fan disk about the central axis and suggesting that each fan disk may be removed and replaced from the fan disk while the engine is on-wing, each fan blade including a shank arranged to extend through a disk aperture formed in the fan disk and coupled to a mount system to support the shank of the fan blade in the disk aperture, and the shank and portions of the mount system are configured to uncouple from the fan disk and be pulled radially outward for replacement.

The illustrative variable-pitch fan 12 includes a fan disk 20, the plurality of fan blades 22, and the mount system 24 all arranged to rotate about the central axis 11 as suggested in FIGS. 1 and 2. The fan disk 20 is formed to include one or more disk apertures 26 sized and shaped to receive the fan blades 22. The fan blades 22 are arranged circumferentially about the central axis 11 and are configured to rotate about corresponding radially extending fan-blade pivot axes 27 to change a pitch (sometimes called an incident angle) of the fan blades 22 as suggested in FIGS. 1 and 2. The mount system 24 couples the fan blade 22 to the fan disk 20 for pivotable movement about the fan-blade pitch axis 27. A fan case 13 is arranged circumferentially around the variable-pitch fan 12 to block air from passing over the fan blades 22.

Figure 3:
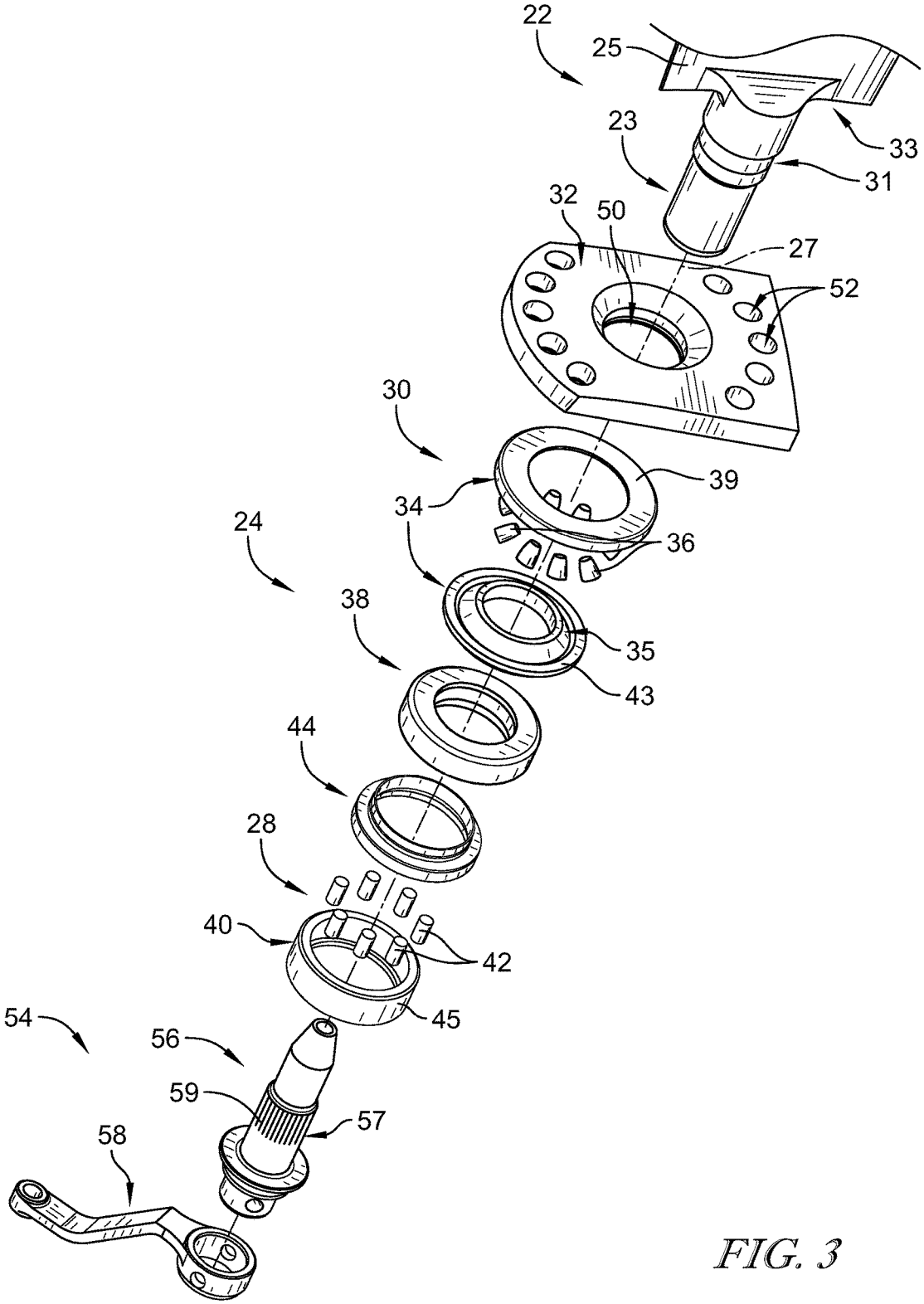
FIG. 3 is an exploded assembly view of the fan blade and the mount system showing, from top to bottom, that the fan blade includes an airfoil and the shank coupled to the airfoil and that the mount system includes a retention plate, an outer bearing unit, and an inner bearing unit, and suggesting that the mount system is configured to couple to a pitch controller including a spline shaft and a rotor control.

Each fan blade 22 includes a shank 23 arranged in the disk aperture 26 and an airfoil 25 that extends radially outward from the fan disk 20 as shown in FIGS. 2 and 3. The shank 23 is coupled with the airfoil 25 and arranged to engage the mount system 24 within the disk aperture 26 to support the airfoil 25 on the fan disk 20. The airfoil 25 is coupled to the shank 23 and is configured to rotate about the fan-blade pitch axis 27 to vary the pitch of the fan blade 22.

The shank 23 includes a shank shaft 31 and a shoulder body 33 as shown in FIG. 3. The shank shaft 31 is formed to include a shank aperture 29 sized and shaped to couple the shank 23 to a pitch controller 54. The shank shaft 31 extends axially into the disk aperture 26 relative to the fan-blade pitch axis 27 from the shoulder body 33. The shoulder body 33 extends radially outward from the shank shaft 31 relative to the fan-blade pitch axis 27. The shoulder body 33 couples the shank 23 to the airfoil 25 using, for example, adhesives, mechanical fasteners, pins, composite forming around retention features or any other suitable coupling means.

The mount system 24 of each fan blade 22 allows for individual replacement of respective fan blades 22 while minimizing the size of the fan disk 20. Specifically, a hub to tip ratio of the variable-pitch fan 12 is minimized. Additionally, the amount of components within disk aperture 26 used to support the shank 23 and the fan blade 22 on the fan disk 20 is minimized.

Figure 4:
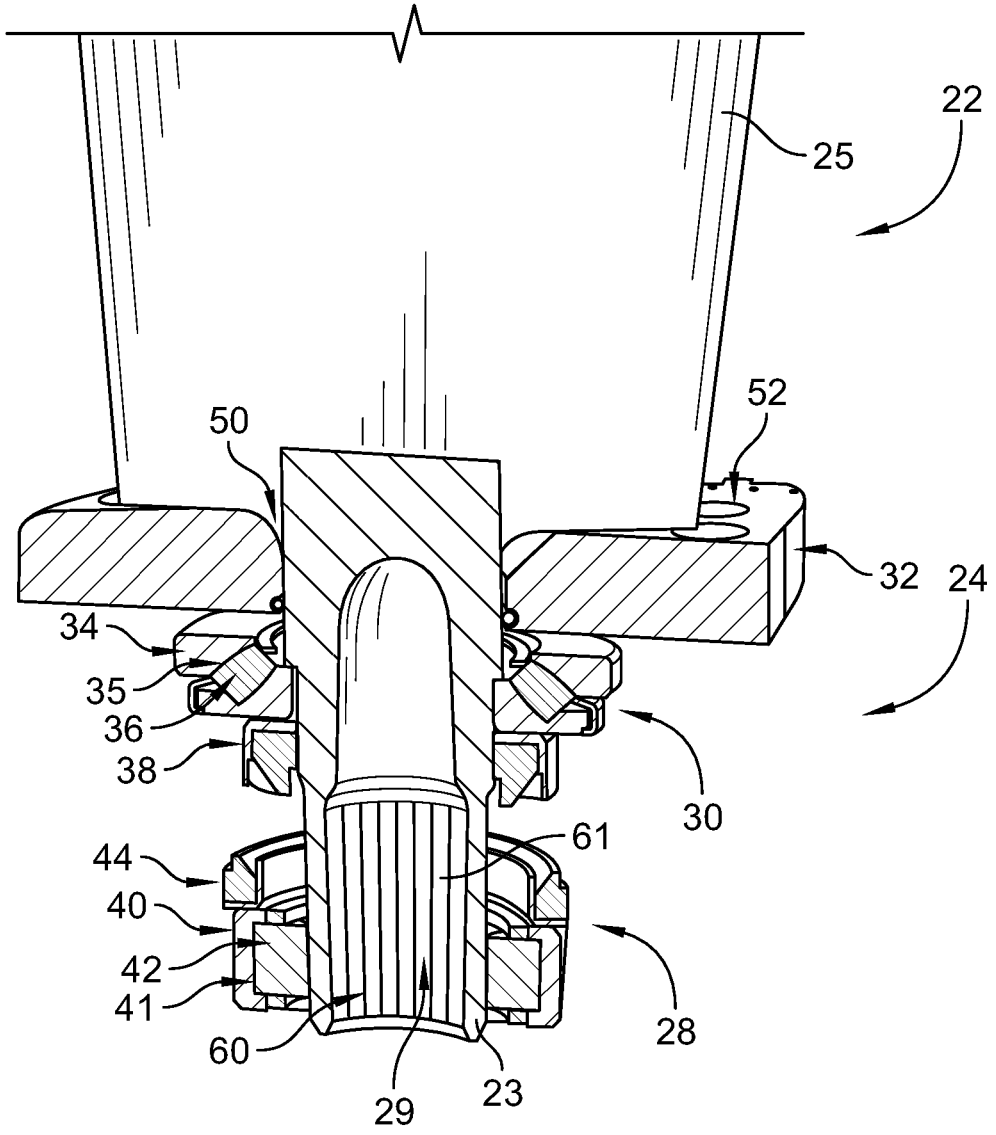
FIG. 4 is a sectional view of the fan blade and the mount system showing that the shank of the fan blade is formed to include an aperture for receiving the spline shaft of the pitch controller, the inner bearing unit includes a roller bearing unit configured to bear radial force loads relative to the pitch axis, and the outer bearing unit includes a spherical tapered roller bearing unit configured to bear axial and radial force loads and configured to tolerate misalignment of the shank of the fan blade in the disk aperture.

The mount system 24 includes an inner bearing unit 28, and outer bearing unit 30, and a retention plate 32 as shown in FIGS. 2-4. In the illustrative embodiment, the inner bearing unit 28 and the outer bearing unit 30 are the only bearing units arranged round the fan blade 22.

The inner bearing unit 28 and the outer bearing unit 30 are located in the disk aperture 26 of the fan disk 20 and are arranged between the shank 23 and the fan disk 20 to bear force loads applied between the fan blade 22 and the fan disk 20 as shown in FIG. 2. The retention plate 32 is configured to couple selectively with the fan disk 20 to block movement of the fan blades 22 with the outer bearing unit 30 out of the disk aperture 26 and is configured to uncouple selectively from the fan disk 20 to allow radial outward movement of the fan blade 22 with the outer bearing unit 30 out of the disk aperture 26 relative to the central axis 11.

In the illustrative embodiment, the outer bearing unit 30 includes a spherical tapered roller bearing unit as suggested in FIG. 2. The outer bearing unit 30 is configured to bear axial and radial force loads relative to the fan-blade pitch axis 27. The axial force loads are transferred from the fan blade 22 via the outer bearing unit 30 to the retention plate 32. The radial force loads are transferred from the fan blade 22 via the outer bearing unit 30 to the fan disk 20. In another embodiment, the outer bearing unit 30 includes a roller bearing unit. In other embodiments, outer bearing unit 30 includes any other suitable bearing unit.

The outer bearing unit 30 includes a roller-bearing housing 34, spherical tapered roller bearings 36, and a spanner nut 38 as shown in FIGS. 3 and 4. The roller-bearing housing 34 is formed to include a roller-bearing space 35 shaped to receive the spherical tapered roller bearings 36. The spherical tapered roller bearings 36 engage the roller-bearing housing 34 to allow for pivotable movement of the fan blade 22 about the fan-blade pitch axis 27. The spanner nut 38 is coupled to the shank 23 axially below the roller-bearing housing 34 relative to the fan-blade pitch axis 27 to position the outer bearing unit 30 axially between the spanner nut 38 and the retention plate 32 relative to the pitch axis 27.

The inner bearing unit 28 is configured to bear radial force loads relative to the fan-blade pitch axis 27 from the fan blade 22 to the fan disk 20 as suggested in FIG. 2. In the illustrative embodiment, the inner bearing unit 28 includes a roller bearing unit. In other embodiments, inner bearing unit 28 includes any other suitable bearing unit.

The inner bearing unit 28 includes a roller bearing housing 40, roller bearings 42, and a spanner nut 44 as shown in FIGS. 3 and 4. The roller-bearing housing 40 is formed to include a roller-bearing space 41 that opens toward the shank 23 and receives the roller bearings 42. The roller bearings 42 engage the shank 23 and the roller bearing housing 40 to allow for pivotable movement of the fan blade 22 about the fan-blade pitch axis 27. The spanner nut 44 is coupled to the fan disk 20 radially above the roller-bearing housing 40 to position the inner bearing unit 28 radially downward away from the retention plate 32. The spanner nut 44 is coupled against the fan disk 20 to retain the inner-bearing unit to the fan disk 20 when the fan blade 22 is removed. The spanner nut 44 may be threaded and coupled to the fan disk 20 via complementary threads formed on the fan disk 20 or may be coupled to the fan disk 20 using any other suitable method.

The retention plate 32 is coupled selectively to the fan disk 20 to retain the fan blade 22 and at least a portion of the mount system 24 to the fan disk 20 as shown in FIG. 2. The retention plate 32 is formed to include a shank aperture 50 and a plurality of fastener apertures 52 spaced circumferentially around the shank aperture 50 as shown in FIG. 3. The shank 23 of the fan blade 22 is arranged to extend through the shank aperture 50. The outer bearing unit 30 is arranged around the shank 23 beneath the retention plate 32 so that the retention plate 32 is arranged between the shoulder body 33 of the fan blade 22 and the outer bearing unit 30. The shoulder body 33 and the outer bearing unit 30 cooperate to block movement of the retention plate 32 away from the fan blade 22.

The retention plate 32 defines a footprint when viewed radially inward toward the central axis. The outer bearing unit 30 fits within the footprint of the retention plate 32. The inner bearing unit 28 may fit within the footprint of the retention plate 32. The inner bearing unit 28 may fit within a footprint of the outer bearing unit 30.

The spanner nut 38 is coupled around the shank 23 against the roller-bearing housing 34 to integrate the fan blade 22 and the outer bearing unit 30 together. The spanner nut 38 may be threaded and coupled to the shank 23 via complementary threads formed on the shank 23 or may be coupled to the shank 23 with any other suitable method. The retention plate 32 is secured to the fan disk 20 with fasteners that extend through the fastener apertures 52 and into corresponding apertures formed in the fan disk 20.

The roller-bearing housing 34 of the outer bearing unit 30 includes an outer-bearing race 39 and an inner-bearing race 43 as shown in FIG. 4. The outer-bearing race 39 is arranged to engage the retention plate 32 in the illustrative embodiment. The inner-bearing race 43 is arranged to engage the spanner nut 38. The outer-bearing race 39 and the inner-bearing race cooperate to define the roller-bearing space 35 between the outer-bearing race 39 and the inner-bearing race 43. The plurality of spherical tapered roller bearings 37 are arranged at an angle between the outer-bearing race 39 and the inner-bearing race 43 to transfer axial and radial force loads from the shank 23 of the fan blade 22.

The roller-bearing housing 40 of the inner bearing unit 28 includes an outer-bearing race 45 as shown in FIG. 4. The outer-bearing race 45 and the shank 23 of the fan blade 22 cooperate to form the roller-bearing space 41. The shank 23 of the fan blade 22 is shaped to interact with the inner bearing unit 28 and act as an inner bearing race for the roller-bearing housing 40. In this way, the disk aperture 26 and the fan disk 20 are minimized. In another embodiment, the roller bearing housing 40 of the inner bearing unit 28 includes an inner-bearing race (not shown). The inner bearing race may be arranged between the shank 23 and the roller bearings 42.

Figure 5:
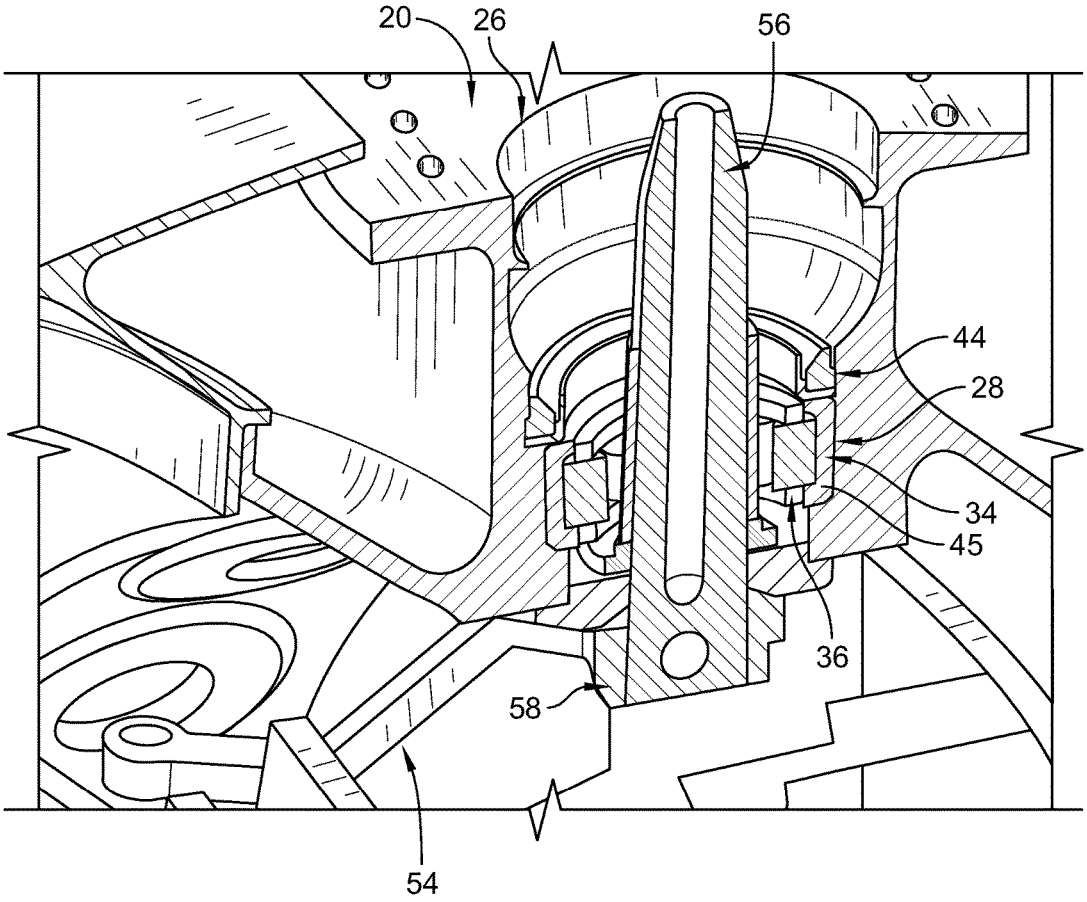
FIG. 5 is a sectional view of the fan disk with the fan blade and a portion of the mount system removed showing that the pitch controller includes the spline shaft that extends radially outward from the central axis into the disk aperture and the rotator control coupled to the spline shaft and configured to rotate the spline shaft about the pitch axis, and showing that the inner bearing unit engages the fan disk and remains in the disk aperture when the fan blade is removed from the fan disk.

The variable-pitch fan 12 further includes a pitch controller 54 that is configured to rotate about the central axis 11 with the fan disk 20. The pitch controller 54 is configured to vary the pitch of the fan blade 22 and includes a spline shaft 56 and a rotor control 58 as shown in FIGS. 3 and 5. The spline shaft 56 extends radially outward from the central axis 11 into the fan disk 20. The spline shaft 56 is sized and shaped to extend into the shank aperture 29 to couple the fan blade 22 to the pitch controller 54 and cause pivotable movement of the fan blade 22 about the fan-blade pitch axis 27. The rotor control 58 is coupled to a radially inner end of the spline shaft 56 and is configured to rotate the spline shaft 56 about the fan-blade pitch axis 27.

The spline shaft 56 includes a plurality of splines 57 disposed on an outer surface 59 of the spline shaft 56 as shown in FIG. 3. The splines 57 are sized and shaped to cooperate with a plurality of complementary splines 60 disposed on an inner surface 61 of the shank 23 defining the shank aperture 29. The splines 57, 60 interlock when the fan blade 22 is assembled on the pitch controller 54 to allow the rotor control to rotate the fan blade 22 and vary the pitch of the variable-pitch fan 12.

Individual fan blades 22 may be replaced by removing the fasteners from the fastener apertures 52 formed in the retention plate 32 as suggested in FIG. 5. Then, the airfoil 25, the shank 23, the outer bearing unit 30, and the retention plate 32 are moved radially outward together from disk aperture 26 formed in the fan disk 20. The inner bearing unit 28 remains coupled to the fan disk 20 within the disk aperture 26 when the fan blade 22 is removed from the fan disk 20. To remove an individual fan blade 22, an outer fan case of the engine 10 may need to be constructed in a way that allows for radial movement of the fan blade 22 relative to the central axis 11. As such, the outer fan case may include a window that may be removed to allow for the radial movement of the fan blade 22 during replacement.

With the fan blade 22 and the mount system 24 removed, the components of the variable-pitch fan 12 may be inspected and reassembled. Additionally, one or more components may be replaced and then reassembled. To reassemble the variable-pitch fan 12, the airfoil 25, the shank 23, the outer bearing unit 30, and the retention plate 32 are moved radially inward into the disk aperture 26. The retention plate 32 is then fastened to the fan disk 20.

In illustrative embodiments, the spline shaft 56 is included in a pitch change mechanism. The spline shaft 56 allows fan blade 22 replacement by staying in place during blade replacement. The spline may transfer moment between the fan blade 22 (via the blade shank) and the pitch change mechanism 54. The centrifugal load of the spline shaft 56 may react against a shoulder in the blade shank. In this way, the centrifugal loads may be transferred through the tapered bearings into the fan hub (sometimes called the disk 20).

In illustrative embodiments, a metallic blade shank 31 is attached to the bottom of the blade 25. This blade shank is attached to the base of the composite fan blade 25 by means such as adhesive, pinning, both adhesive and pinning, composite forming around retention features, etc. Via the attachment, the blade shank 31 retains the fan airfoil 25 and may transfer loads from the airfoil into the bearings. The blade shank 31 provides mounting for the spherical tapered roller bearing at the outboard end of the blade shank 31. The blade shank 31 provides the inner race surface for the roller bearing 28. By integrating the roller bearing inner race into the blade shank 31, the space claim may be minimized and may enable the lowest possible hub to tip ratio.

The shank 31 includes splines that extend along a length of the shank 31. The shank 31 further includes pilot diameters and pilot lengths on each side of the splines. The pilot diameters and pilot lengths may allow the splines to have much better durability and the pilot lengths are set to manage the order of engagement, making assembly easier. The pilot diameters are machined to a close tolerance and are generally in round. The pilot diameters extend along a distance of the pilot lengths.

In some embodiments, the roller bearing unit 28 includes an inner race that is removably coupled to the blade shank 31. The removable inner race may increase the spherical tapered roller bearing inner diameter and may increase the minimum hub diameter of the fan. The option could be used to allow replacement of the roller bearing inner race without machining or replacing the blade shank 31 and/or fan blade. Optionally, this may allow for a more optimum blade shank material to be chosen.

In illustrative embodiments, a spherical tapered roller bearing 30 is coupled to the outboard end of the blade shank 31. The tapered roller bearing 30 is attached to the blade shank 31 via a spanner nut 38. The tapered roller bearing 30 may transfer centrifugal loads and moment couple radial loads (paired with the roller bearing). The spherical tapered roller bearing 30 may allow more forgiveness for tolerances and misalignment (for example, up to 3 degrees misalignment). The tapered roller bearing 30 may provide an effectively larger distance between the bearings when transferring the moment couple and may reduce the required size of the bearings. The tapered roller bearing 30 may reduce the number of bearings needed since a tapered roller bearing may carry both axial and radial loads at the same time. In some embodiments, the outer bearing unit is a tapered roller bearing unit (non-spherical).

In illustrative embodiments, a roller bearing 28 is coupled to the inboard end of the blade shank 31. The roller bearing 28 is held in place in the fan hub via a spanner nut. The roller bearing 28 remains in the fan hub during fan blade replacement. The inner race of the roller bearing 28 may be integrated with the blade shank 31. This arrangement may result in a much smaller space claim.

In illustrative embodiments, a blade retention plate 32 is coupled to the fan hub. Bolts may be accessible on the wing for single blade replacement. Socket head capscrews in counterbores may maximize aerodynamics of the bolt arrangement. The retaining plate 32 may provide a face against which the spherical tapered roller bearing transfers centrifugal loads.

In illustrative embodiments, the arrangement and assembly of the bearings may allow for single blade replacement and may minimize space claim. Also this arrangement may allow on wing replacement of single blades and inspection and replacement of the blade bearings on the wing. Another aspect of the disclosure is to minimize the fan hub diameter using the features described herein.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A variable-pitch fan for use with a gas turbine engine, the variable-pitch fan comprising a fan disk mounted for rotation about a central axis, the fan disk formed to include a disk aperture that extends radially into the fan disk, a fan blade coupled to the fan disk for primary rotation with the fan disk about the central axis to produce thrust and for variable-pitch rotation about a pitch axis that extends radially from the central axis, the fan blade including a shank arranged in the disk aperture and an airfoil that extends radially away from the fan disk, and a mount system configured to support the shank of the fan blade in the disk aperture, the mount system including an inner bearing unit, an outer bearing unit, and a retention plate, the inner and outer bearing units located in the disk aperture and arranged between the fan blade and the fan disk to bear force loads applied between the fan blade and the fan disk, and the retention plate arranged around the shank of the fan blade and configured to couple selectively with the fan disk to block movement of the fan blade with the outer bearing unit out of the disk aperture and configured to uncouple selectively from the fan disk to allow radial outward movement of the fan blade with the outer bearing unit out of the disk aperture relative to the central axis.

2. The variable-pitch fan of claim 1, wherein the inner bearing unit includes a roller bearing unit configured to bear radial force loads relative to the pitch axis and the outer bearing unit includes a spherical tapered roller bearing unit configured to bear axial and radial force loads and configured to tolerate misalignment of the shank of the fan blade in the disk aperture.

3. The variable-pitch fan of claim 2, wherein the inner bearing unit and the outer bearing unit are the only bearings arranged around the shank of the fan blade.

4. The variable-pitch fan of claim 3, wherein the inner bearing unit is spaced apart radially from the retention plate relative to the central axis and the outer bearing unit is located radially between the inner bearing unit and the retention plate.

5. The variable-pitch fan of claim 2, wherein the inner bearing unit is spaced apart radially from the retention plate relative to the central axis and the outer bearing unit is located radially between the inner bearing unit and the retention plate.

6. The variable-pitch fan of claim 1, wherein the airfoil comprises composite material and the shank comprises metallic material and the airfoil is coupled to the shank for movement therewith.

7. The variable-pitch fan of claim 5, wherein the shank includes a shank shaft and a shoulder body, the shank shaft extends axially into the disk aperture relative to the pitch axis from the shoulder body, the shoulder body extends radially outward from the shank shaft relative to the pitch axis, and the shank shaft forms an inner race of the inner bearing unit.

8. The variable-pitch fan of claim 1, wherein the outer bearing unit includes a tapered roller bearing unit.

9. The variable-pitch fan of claim 1, further comprising a pitch controller configured to rotate about the central axis with the fan disk, the pitch controller includes a spline shaft that extends radially away from the central axis into the disk aperture and a rotator control coupled to the spline shaft and configured to rotate the spline shaft about the pitch axis.

10. The variable-pitch fan of claim 8, wherein the shank shaft is formed to include a shank aperture that extends axially into the shank shaft relative to the pitch axis and the spline shaft of the pitch controller extends into the shank aperture to couple the fan blade with the pitch controller.

11. A variable-pitch fan for use with a gas turbine engine, the variable-pitch fan comprising a fan disk mounted for rotation about a central axis, a fan blade that extends into the fan disk for primary rotation with the fan disk about the central axis and for variable-pitch rotation about a pitch axis that extends radially from the central axis, the fan blade including a shank that extends into the fan disk and an airfoil that extends radially away from the fan disk, and a mount system including an outer bearing unit and a retention plate, the outer bearing unit coupled to the shank of the fan blade, and the retention plate arranged around the shank of the fan blade and configured to couple selectively with the fan disk to block movement of the fan blade and the outer bearing unit away from the fan disk and configured to uncouple selectively from the fan disk to allow movement of the fan blade and the outer bearing unit away from the fan disk.

12. The variable-pitch fan of claim 11, wherein the mount system further includes an inner bearing unit and the outer bearing unit and the inner bearing unit are the only bearing units arranged around the fan blade.

13. The variable-pitch fan of claim 12, wherein the inner bearing unit includes a roller bearing unit and the outer bearing unit includes a spherical tapered roller bearing unit.

14. The variable-pitch fan of claim 13, wherein the inner bearing unit is spaced apart radially from the retention plate relative to the central axis and the outer bearing unit is located radially between the inner bearing unit and the retention plate.

15. The variable-pitch fan of claim 11, wherein the shank includes a shank shaft and a shoulder body, the shank shaft extends into the fan disk, and the shoulder body extends radially outward from the shank shaft relative to the pitch axis.

16. The variable-pitch fan of claim 15, wherein the mount system further includes an inner bearing unit and the shank shaft forms an inner race of the inner bearing unit.

17. The variable-pitch fan of claim 15, further comprising a pitch controller configured to rotate about the central axis with the fan disk, the pitch controller includes a spline shaft that extends radially away from the central axis into the spline shaft and a rotator control coupled to the spline shaft and configured to rotate the spline shaft about the pitch axis.

18. A method comprising providing a variable-pitch fan including a fan disk mounted for rotation about a central axis, a plurality of fan blades coupled to the fan disk for primary rotation around the central axis, and a respective mount system for each of the fan blades, each mount system including an inner bearing unit coupled to the fan disk, an outer bearing unit coupled to the fan blade radially outward of the inner bearing unit, and a retention plate coupled to the fan disk radially outward of the outer bearing unit, and moving the fan blade, the outer bearing unit, and the retention plate radially outward away from the fan disk to separate the fan blade, the outer bearing unit, and the retention plate from the fan disk.

19. The method of claim 18, wherein the fan blade includes an airfoil and a shank coupled to the airfoil and the shank forms an inner race of the inner bearing unit.

20. The method of claim 18, wherein the inner bearing unit includes a roller bearing unit and the outer bearing unit includes a spherical tapered roller bearing.

* * * * *